United States Patent [19]

Soderlind et al.

[11] 4,036,438

[45] July 19, 1977

[54] ANTI-INJECTION PAINT SPRAY NOZZLES

[75] Inventors: Richard Leroy Soderlind; Glenn A. L. Lund, both of Minnetonka, Minn.

[73] Assignee: Sperry Tech Corporation, Minneapolis, Minn.

[21] Appl. No.: 597,757

[22] Filed: July 21, 1975

[51] Int. Cl.[2] ..... B05B 1/04

[52] U.S. Cl. ..... 239/288.5; 239/DIG. 22

[58] Field of Search ..... 239/332, 288, 288.3, 239/288.5, 15, DIG. 22

[56] References Cited

U.S. PATENT DOCUMENTS

| | | | |
|---|---|---|---|
| 1,974,809 | 9/1934 | Dodge | 285/9 R |
| 3,120,347 | 2/1964 | Duke, Jr. | 239/332 |
| 3,129,892 | 4/1964 | Tillman | 239/DIG. 22 |
| 3,263,934 | 8/1966 | Hope, Jr. et al. | 239/DIG. 22 |
| 3,565,344 | 2/1971 | Takei et al. | 239/332 |
| 3,599,876 | 8/1971 | Kyburg | 239/DIG. 22 |
| 3,814,329 | 6/1974 | Clark | 239/DIG. 22 |

*Primary Examiner*—Evon C. Blunk
*Assistant Examiner*—Michael Mar
*Attorney, Agent, or Firm*—Hill, Gross, Simpson, Van Santen, Steadman, Chiara & Simpson

[57] ABSTRACT

A paint spray nozzle assembly for use with airless spray painting nozzles to protect against injection of sprayed paint through the skin of a user. The assembly includes a conically depressed nozzle cap with the nozzle opening at the bottom of the cone depression, the cone having a critical minimum depth. An additional assembly portion includes a projecting barrier extending outwardly beyond the nozzle preventing unintentional contact between the skin of the user and the fluid stream from the nozzle for a sufficient distance beyond the nozzle opening to prevent skin injection.

9 Claims, 12 Drawing Figures

ANTI-INJECTION PAINT SPRAY NOZZLES

BACKGROUND OF THE INVENTION

1. Field of the Invention

This invention relates to airless paint spraying equipment and more particularly to a safety nozzle assembly for such equipment.

2. Description of the Prior Art

Airless paint spraying has recently become an important segment of the paint spraying equipment market. Such "airless" equipment propels only paint, or other fluid to be sprayed, through a spray nozzle without admixture of air. Because only sprayed fluid, exits the nozzle rather than the more normal combination of air and paint, "airless" systems have numerous advantages.

However, it has been found in certain exceptional instances, that injury can occur from the use of such airless systems. One common feature of airless equipment is the high pressure at which the sprayed fluid stream is forced through the nozzle opening. Pressures on the order of 175–210 kilograms per square centimeter (2500–3000 p.s.i.) have been encountered in connection with small hand-held electric spray guns and normal operating pressures between 112 and 155 kilograms per square centimeter (1600 and 2200 p.s.i.) are common to such units.

At such pressures, the exiting stream of fluid can penetrate the skin of a user. Where the sprayed fluid is toxic, this penetration can have adverse effects upon the user.

During experimentation, we have found that penetration can occur in one of two ways. One form of penetration occurs when the user covers the nozzle, usually with a finger, for purposes of cleaning the nozzle or otherwise. If the spray gun is actuated at such time with the finger in contact with the nozzle opening, penetration of the skin can occur. A second type of penetration occurs when the spray equipment is operating and a stream of fluid is being ejected. At such time, if the user's skin passes through the stream, either by accidentally misdirecting the gun, or otherwise, penetration can also occur. However, we have found, during experimentation, the critical distances are involved and that unless the user's skin is positioned sufficiently close to the nozzle opening, no penetration will occur.

In tests using the shaved skin of a rabbit, it has been determined that paint sprayed from a small "airless" hand-held unit can penetrate the skin spreading out along the underlying fascia but not penetrating the underlying muscle when the nozzle tip was placed directly against the skin and the unit thereafter activated. Such small units are known, in the industry, as cup guns. Examples of such guns are shown in U.S. Pat. Nos. 3,116,879; 3,445,068 and 3,680,789 all issued on applications of Josef Wagner.

Such cup guns include a body member with a depending handle from which a removable paint container is suspended. The body member includes an electric motor having a vibrating member, such as an armature, which drives a paint propelling member, either a piston or a liquid or dry diaphragm, which on one stroke sucks paint from the container into a cylinder and which on the opposite stroke forces the paint from the cylinder through a nozzle attached to the body member. Both the stroke of the oscillating member and the size of the spray nozzle opening are variable providing variance in pressures, delivery rates and spray patterns. However, in the vast majority of instances, the spray nozzles have a final circular opening therein. A typical nozzle is shown in U.S. Pat. No. 3,116,879.

Many of such devices operate by forcing the paint through the nozzle opening at a high velocity such that the paint is immediately atomized downstream of the gun. In order to produce effective atomization, and the desired high velocities, it is necessary to propel the paint or other fluid to be sprayed by the application of a very high pressure. Since the paint exits through a circular nozzle opening on the order of 0.28 millimeters to 1.8 millimeters (0.011 to 0.072 inches) in diameter, the resultant stream, although pulsed due to the reciprocating action of the piston, can act in the manner of a hypodermic and pierce human skin.

However, because of the atomization of the paint, and because the natural fluid flow downstream from the opening is in the shape of a cone, this ability to act as a hypodermic is directly proportional to distance from the nozzle opening to the skin. There is therefore a critical distance area beyond which no skin penetration will occur but within which penetration can, in unusual instances, occur.

Although, in other embodiments, not dealing with airless cup gun spraying equipment, nozzle designs have evolved which include projections extending beyond the nozzle opening, such designs have not been concerned with preventing injection nor have they been dimensioned adequately to provide anti-injection features. Examples of prior art nozzles having projections extending beyond the nozzle opening are U.S. Pat. No. 3,754,710 to Chimura; U.S. Pat. No. 3,836,082 to Krohn; U.S. Pat. Nos. 3,780,953 and 3,844,487 to Malec and other similar devices dealing with paint spray equipment. In addition, air guns have also been provided with projections for purposes entirely different from preventing injection. See for example U.S. Pat. No. 2,597,573 to De Groff and U.S. Pat. No. 3,599,876 to Kyburg.

It would therefore be desirable to provide a safety apparatus which would prevent occurrence of penetration within the critical area.

Additionally, in the design of a protective tip apparatus, it may be advantageous to provide means for preventing both accidental contact between a paint stream exiting the nozzle opening and the skin of a user and contact resulting from misuse of the spraying equipment such as, for example, placing one's finger over the opening and initiating operation of the paint sprayer in a mis-guided attempt to test pressure build-up or to test operation or to clean a fouled tip. The prior art has not attempted to provide solutions to such accidental or intentional contacts.

SUMMARY OF THE INVENTION

Our invention overcomes the disadvantages of the prior art and provides a safety nozzle assembly for airless cup gun paint sprayers. The assembly includes two distinct features which combine to provide a total safety nozzle. One feature involves the placement of the nozzle opening at the bottom of a conical depression in the nozzle end. The conical depression is preferably dimensioned with a cone angle maintained relatively small. We have determined that the depth of the conical depression may advantageously be approximately 8.9 millimeters to 3.1 millimeters (0.350 inch to 0.125 inch) for reasons which are explained hereinafter.

A second portion of the apparatus includes a projecting guard member which extends outwardly from the tip and which forms a barrier preventing accidental excursion of a user's skin into the area of the paint stream within a critical area downstream of the nozzle opening. This projection preferably has features preventing entry of skin into the area while allowing air flow through the area around the paint stream. In one embodiment this protective extension consists of a tightly wound metal coil having a reduced diameter at one end for attachment to the cup gun nozzle with the coils adjacent the reduced diameter end allowing free flow of air into the interior of the projection. Another embodiment, the protective extension comprises a plurality of ribbed projections extending from adjacent the cup gun nozzle outwardly to a continuous annular end, the projections being spaced relatively close together but allowing free air passage therebetween.

It is therefore an object of this invention to provide a safety assembly for airless paint spraying equipment nozzles to prevent injection of the sprayed fluid into the skin of a user.

It is another and more important object of this invention to provide a safety tip for airless paint spraying equipment which prevents accidental passage of a user's skin into a critical area downstream of the spray nozzle in which skin injection by the pumped fluid stream can occur.

It is another important object of this invention to provide a safety nozzle tip for airless paint spraying cup guns with the nozzle opening placed at the bottom of a conical depression surrounding the nozzle opening, the depression having dimensions sufficient to prevent injection of a user's skin.

It is another object of this invention to provide a conical depression surrounding the nozzle of an airless paint spraying cup gun with the nozzle opening located at the apex of a continuous wall cone or at the bottom center of a truncated cone, the cone having a depth sufficient to prevent injection of the skin of a user by a pumped fluid stream emitted from the nozzle opening when the skin covers the cone opening.

It is a general object of this invention to provide a protective apparatus for airless paint spray cup guns which will reduce the possibility of accidental injection of pumped fluid through the skin of a user by restricting access of the skin to a critical area adjacent to and downstream of the spray nozzle.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
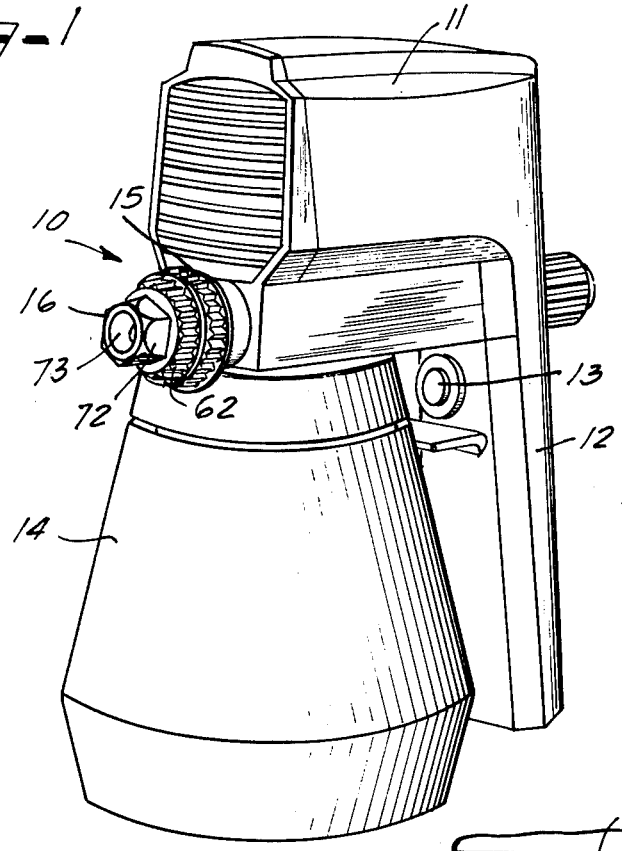
FIG. 1 is a perspective view of an airless paint spray cup gun equipped with an anti-injection nozzle according to this invention.
Figure 3:
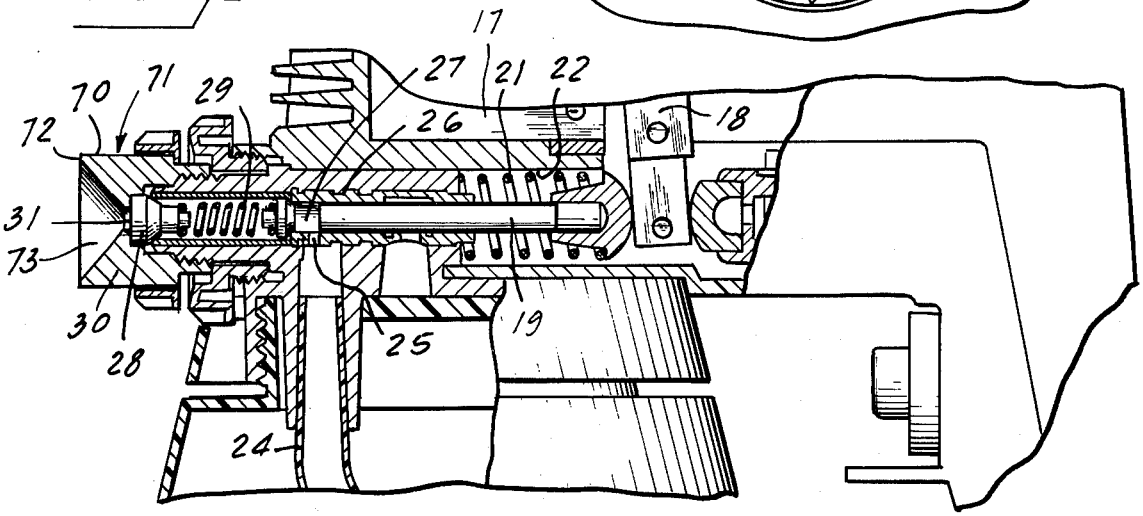
FIG. 3 is a fragmentary cross sectional view of the cup gun and nozzle of FIGS. 1 and 2.

FIG. 1 illustrates a spray gun 10 generally of the type shown and described in Josef Wagner's application for U.S. Pat. Ser. No. 478,856 filed June 13, 1974. The spray gun includes a gun housing 11 with a handle portion 12 depending therefrom, the handle portion being equipped with an actuating trigger 13 for initiating spraying. A paint cup 14 also depends from the housing and is adapted to be filled with paint. The front portion 15 of the gun housing is equipped with a discharge nozzle 16 from which the paint or other fluid to be propelled from the container 14 is discharged. As best illustrated in FIG. 3, an electromagnet 17 is disposed within the housing 11 and includes an oscillating armature 18 which operates against the end of a piston 19 mounted in a cylinder 20. A return spring 21 mounted in a bore 22 of the housing biases the piston 19 against the armature 18. A suction tube 24 extends into the interior of the paint container 14 and communicates through an opening 25 to the interior of the cylinder 20 ahead of the piston 19. On the backstroke of the piston 19 under the influence of the spring 21, paint will be sucked from the container 14 into a pumping chamber 27 ahead of the piston. On the forestroke, the paint will be forced through the pumping chamber 27 past an inlet valve 20 and through a compression chamber 32 and an outlet valve 28 which is of the atomizing type. On the return stroke, a spring 29 biases the inlet valve 20 against a valve seat 23 to seal chamber 27 to start another cycle. It is to be noted that the nozzle opening number 31 has a diameter less than the diameter of the chamber 27 and 32 and it will be appreciated that the forward stroke of the piston 19 will compress the paint or other fluid to be sprayed contained in the chamber 27 and chamber 32 to a high pressure and force it through the nozzle opening 31 at very high velocity. Normally the nozzle 30 terminates in a flat outside wall through which the nozzle opening 31 projected. Such a nozzle is shown in U.S. Pat. No. 3,445,068.

After passing through the nozzle 30, the paint or other fluid sprayed will immediately begin to atomize and will spread outwardly from the nozzle opening 31 in a conical manner. However, the spray pattern immediately adjacent to the nozzle opening is somewhat in the form of a cylinder, the dimensions being determined by the nozzle opening size and the dimensions of the cone formed downstream of the cylinder determined by the nozzle opening size and the viscosity of the liquid being sprayed. Cup guns of the above described type utilize nozzle openings of between 0.28 mm and 1.83 mm (0.011 and 0.072 inches). Such guns generally operate between a pressure of 112 and 155 kilograms per square centimeter (1600 and 2200 p.s.i.) at the nozzle. The included angle of the conical spray formed downstream of the nozzle may be from 20° to 100° with the usual range falling below 90° and generally in the area of 50° to 70°.

As the spray fluid exits the nozzle, in some unusual circumstances it can penetrate the skin of a user due to the velocity created by the pressure through the nozzle opening. As the distance from the nozzle opening increases the mass velocity per square inch decreases due to atomization into small particles and increase of cone diameter and the ability to penetrate skin reduces. Finally at a given distance no penetration of human skin can occur irrespective of the duration of impingement by the sprayed stream. In order to provide a safety nozzle assembly we have determined that accidental skin penetration can occur in one of two ways. Either skin is placed over the nozzle opening and the cup gun is then actuated or skin is accidentally brought into contact with the stream of fluid being discharged. Because the impingement of the stream on the skin will become noticeable, even to the point of painfulness, before skin penetration can occur, it is not assumed that injection will be the result of a prolonged time contact between the skin and an existing stream of sprayed fluid or that the skin of the user, generally extremities such as a finger, will be brought continiously to the nozzle orifice in the path of a continually discharged stream.

Figure 10:
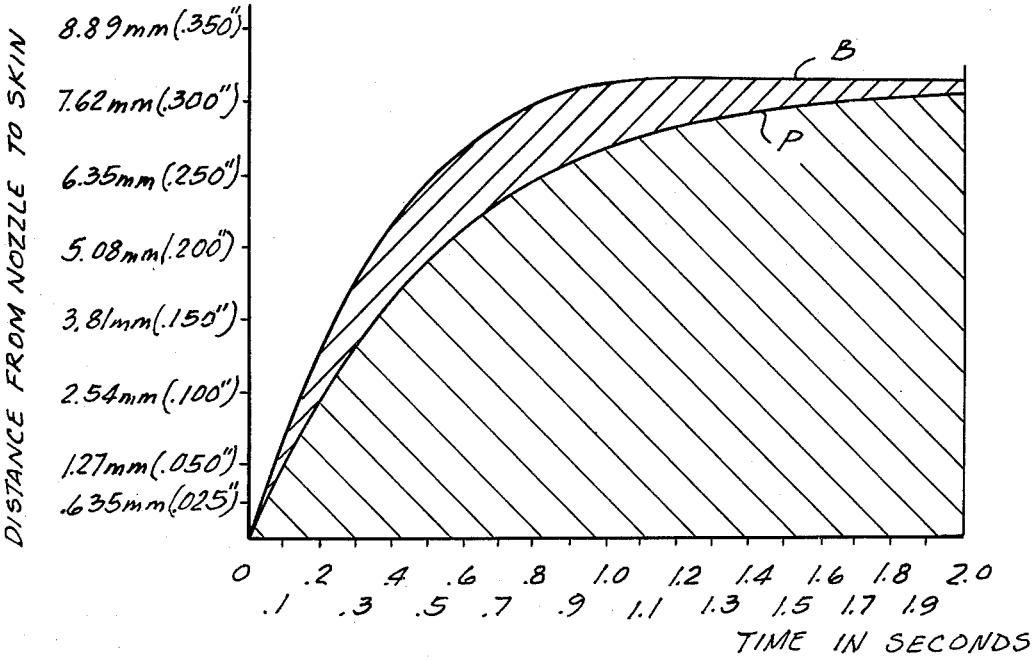
FIG. 10 is a graph illustrating injection parameters.

On tests made on the shaved skin of rabbits, it has been determined that penetration is both a factor of distance from the nozzle orifice and duration of contact. As depicted in FIG. 10, such tests have shown that penetration may occur for combinations of distance from the orifice, ploted on the vertical axis, and duration of spray, ploted on the horizontal axis, which fall below the line P. The line B shows those combinations of distance and duration where no penetration will occur but in which there may be some bruising of the skin. The data ploted in FIG. 10 were results of penetration tests conducted on rabbit skin laminated to a foam backing to simulate human flesh. The distance from the nozzle opening to the rabbit skin, and the cup gun activation time duration were independently varied. Water was the liquid being sprayed. As shown on the chart, penetration will not occur in rabbit skin placed greater than 0.300 inch from the orifice even when subjected to a spray duration of two seconds. Although no further testing has been done, extrapolation of the line P indicates that no penetration will occur beyond a distance of 8.9 millimeter (0.350 inch) irrespective to the duration of the spray. The exact correlation between human skin and rabbit skin is not known, however rabbit skin is a standard test medium for injection penetration and it is believed in all instances that human skin has a penetration resistance at least as great as the tested rabbit skin resulting in a corresponding safety factor.

As mentioned above the chart in FIG. 10 is the result of testing with the skin being positioned prior to initiation of spray. From other testing it is believed that where the spray is continuous and the skin is brought into contact with the spray and maintained in contact, no penetration whatsoever can occur at a distance greater than 15.9 millimeters (0.625 inch) by a cup gun producing on the order of between 140 and 210 kilograms per square centimeter (2,000 and 3,000 p.s.i.) from a nozzle orifice having a diameter greater than 0.25 millimeter (0.010 inch).

We have therefore determined that a critical area exists downstream of the nozzle which critical area has a maximum distance from the nozzle opening of 15.9 millimeters (0.625 inch). We have also determined that there is a further critical area within that area having a maximum distance of 8.9 millimeters (0.350 inch). Within this second critical area, skin penetration can occur from accidental start up of the cup gun when skin is placed over the orifice within the 8.9 millimeters (0.350 inch) distance. Beyond that range, skin penetration will not normally occur on start up but may possibly occur if skin is moved into an area less than 15.9 millimeters (0.625 inch) from the orifice and maintained in that area in contact with a constant stream from the orifice such as might occur when an operating spray gun is accidentally misdirected, for example at a person's hand. It is believed that this misdirection during continious operation of the spray gun presents a different problem from accidentally triggering the spray gun when skin is closely adjacent to the nozzle. One reason that this is a different problem calling for a different solution, is the fact that accidental triggering is usually for an extremely short duration whereas misdirection during continuous operation can cause sprayed fluid-skin contact for a longer duration.

Additionally, the type of injection that can occur with accidental triggering, can be the result of an intentional placing of the skin for purposes such as testing gun operations or cleaning a fouled tip. While such intentional placement can be discouraged through normal warning devices, it would be advantageous if additional safety devices could be provided to prevent this. On the other hand, misdirection of the gun can occur under many circumstances but can be safeguarded against by providing a barrier preventing the skin from accidentally coming closer than 15.9 mm (0.625 inch) from the nozzle orifice.

FIGS. 1, 2, 3, and 11 show an embodiment which prevents the accidental triggering type of injection from occurring and FIGS. 4 through 7 and 12 show an embodiment which prevents misdirection type of injection from occurring. The combination of the two embodiments will provide an all purpose safety assembly for airless paint spray cup guns.

Figure 11:
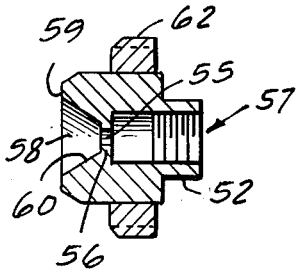
FIG. 11 (on page 1 of the drawings) is a cross sectional view of an anti-injection nozzle similar to that illustrated in FIGS. 1, 2 and 3.
Figure 2:
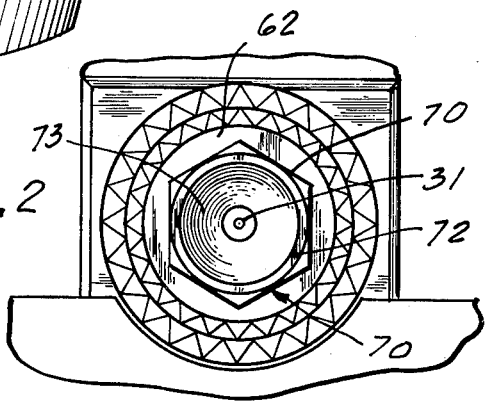
FIG. 2 is a front plan view of the nozzle of the cup gun of FIG. 1 on an enlarged scale.
Figure 8:
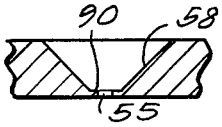
FIGS. 8 and 9 are fragmentary cross sectional views of the anti-injection nozzle of FIGS. 1 and 11.
Figure 9:
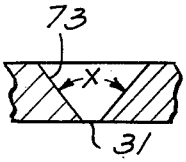

The embodiment shown in FIGS. 1, 3, and 11, and in diagrammatic views in FIGS. 8 and 9, is designed to prevent skin injection as a result of accidental triggering of the device when the user'skin, such as a finger, is placed immediately adjacent the nozzle opening. This embodiment functions by preventing the skin from contacting the nozzle orifice. As best shown in FIG. 11 the nozzle 50, which is equivalent to the nozzle 30, is formed having a hexagonal outer diameter surface 51 with a threaded cylindrical portion 52 extending therefrom for attachement to the pump, as shown in FIG. 3. The orifice 55 is formed in a end wall 56 closing a bore 57 which extends from the threaded end. The head portion 50 extends axially outwardly beyond the orifice 55 and has an opening 58 which increases in diameter from adjacent the orifice to the axial end 59 of the head portion 50. The opening 58 is preferrably conical with wall 60 extending outwardly at an angle sufficient to avoid interference with the stream of pumped fluid exiting the orifice 55. In the embodiment shown in FIG. 11, a plastic member 62 is fitted around the hexagonal surface 51 and may have a serrated outer diameter allowing the complete spray tip to be easily threaded into position on the cup gun. The embodiment illustrated in FIG. 3 differs in that the cone, shown with a larger included angle, terminates adjacent the outer diameter 70 of the headed portion 71 leaving a small annular axial end face 72 between the cone or conical depression 73 and the outer diameter 70. Again the headed portion 71 may be hexagonal and receive a tightening member 62 therearound.

As best illustrated in FIGS. 8 and 9 the conical depression 58 of FIG. 8, or 73 of FIG. 9, may extend outwardly either from immediately at the nozzle opening 31, as in the case of cone 73, or may be truncated having a ledge portion 90 surrounding the nozzle opening 55 and extending radially outwardly a small distance.

It has been found that, when using the conical depression as illustrated, the skin penetration slope shown in FIG. 10 can be obtained. It is not entirely understood why this occurs, however it is believed that a hydrostatic cushion is created. As can be seen from FIG. 10 at a distance of 5.1 mm (0.20 inch) from the nozzle orifice, penetration will not occur unless the spray is continued for one half second. It is believed that by using the conical depression the amount of fluid released into the depression, and retained therein by contact with the user's skin covering the open end of the depression will cause a sufficient accumulation of fluid within the cone to interfere with further fluid coming from the nozzle. In this manner, a hydrostatic cushion or fluid blockage is created within the cone and before penetration can occur according to the time-distance chart in FIG. 10, the cone will be sufficiently full of fluid to prevent penetration from occurring.

As mentioned previously the included angle of the spray from the nozzle opening depends both upon viscosity of the fluid being sprayed and upon the size of the nozzle opening. With standard nozzle openings between 0.28 and 1.83 mm (0.011 and 0.072 inch), normal included angles of spray are between 35° and 70°. In order to prevent paint contact with the cone wall the cone should have an included angle X which is greater than the spray angle in the case of the cone shown in FIG. 9. The nozzle of FIG. 8 may have an included angle equal to the spray angle because of the existence of the radial land 90.

Although, because of the hydrostatic cushion effect of the entrapped spray within the conical depression it is believed that penetration will occur only at distances equal to or less than and times equal to or greater than indicated in FIG. 10, because the finger of a user can depress into the opening end of the conical depression, it has been determined that the optimum depth of the conical depression should be on the order of 8.8 mm (0.350 inch). At that depth the cone of FIG. 9, equipped with a 1.3 mm (0.05 inch) diameter nozzle opening will have a open end diameter of approximately 9.53 mm (0.375 inches) for an included angle of 50°; 15.2 mm (0.6 inch) for an included angle 75° and 19.0 mm (0.75 inch) for an included angle of 90°. The open diameter of the cone of FIG. 8 will be increased by the additional dimension of the set back land 90.

Because the greater the degree of included angle of the conical depression, and the larger the land 90 the greater the amount a finger can penetrate into the open cone, it is desired to keep the land 90 and the included angle relatively small. However the land 90 aids in preventing paint build-up at the nozzle opening and is therefore desirable In addition, of course, the included angle must be at least equal to the angle of the spray.

We therefore concluded that for tip sizes between 0.28 and 1.83 mm (0.011 and 0.072 inch) in diameter, the cone should have depth of between 3.2 and 8.9 mm (0.125 and 0.350 inch) an included angle of between 35° and 90° and an open end diameter approximately ⅜ to ¾ of an inch. Within these perimeters it is believed that the hydrostatic cushion effect above described will occur and that injection of human skin will not occur when the skin is placed over the open end of the cone and the cup gun as actuated. In this manner, the above described embodiment is adequate to prevent not only accidental skin penetration from occurring during accidental activation but also to prevent intentional injection from occurring in those instances where the user has intentionally disregarded safety precautions and placed his finger at the nozzle opening.

The embodiments illustrated in FIGS. 4 through 7 and 12 protect against the type of injection which can occur by misdirection of an already operating cup gun. Because the hydrostatac cushion effect of the previously described embodiment requires that the conical depression be substantially closed by the skin, it is not completely effective to prevent skin injury when the cup gun is continiously operating and the fluid stream is directed against human skin.

Research has indicated that skin penetration using the above described nozzle size ranges and the above mentioned pressures of less than approximately 210 kilograms per square centimeter (3,000 p.s.i.) can occur up to 15.9 mm (0.625 of an inch) away from the nozzle. It has therefore been determined that by providing a barrier by against accidental skin contact within 15.9 mm (0.625 inch) of the nozzle, the possiblity of accidental skin injection due to a misdirection type of accident can be eliminated. It is believed the reason skin penetration substantially will not occur beyond 15.9 mm (0.625 inch) has to do with the diameter of the spray. Even assuming the use of an extremely small nozzle, which is only used with the lower viscosity fluids such as stains and the like, the diameter of the paint spray 15.9 mm (0.625 inch) from the orifice is relatively large. For example using a spray having an included angle of 35°, the spray diameter 15.9 mm (0.625 inch) from the orifice is 10.2 mm (0.40 inch). A more normal 70° spray has a diameter in excess of 22.2 mm (0.875 inch) at 15.9 mm (0.625 inch) while a 90° included spray will have a 30.5 mm (1.2 inch) diameter. Therefore by providing a barrier which extends at least 15.9 mm (0.625 inch), and preferably slightly in excess of that, it is possible to eliminate accidental skin penetration.

However, the barrier must have a diameter at its terminus end remote from the nozzle greater than the diameter of the spray at that point. In addition it has been determined that providing a complete shell barrier such as a closed cylinder extending outwardly from the cup gun, can have adverse effects upon the spray. It is believed that turbulence can build up interior of such a closed system which would effect the operation of the unit. For this reason, our barrier is designed to allow free air flow interiorly thereof while at the same time, preventing accidental injury.

Figure 4:
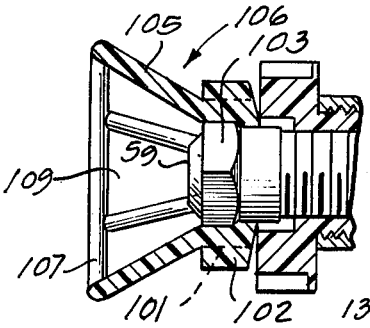
FIG. 4 is a fragmentary cross sectional view of a nozzle for a cup gun provided with a safety extension.
Figure 5:
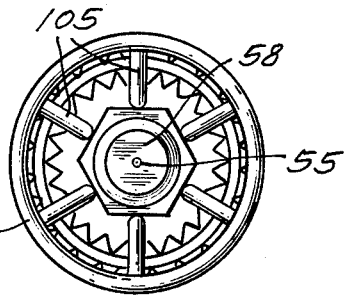
FIG. 5 is front plan view of the nozzle of FIG. 4.

FIG. 4 illustrates one form of a protective extension 100 which consists of a substantially rigid number 101 having a nozzle end 102 adapted to be received around the nozzle 103. For example, the end 102 can be formed as part of the member 62 of FIG. 11. A plurality of spokes 105 extend outwardly of the head end 102 diverging from the nozzle 103 at an angle sufficiently large to avoid contact between the spray from the nozzle opening and the spokes 105. The spokes extend from the nozzle opening by a distance equal to least 15.9 mm (0.625 inch) and preferably approximately 19.1 mm (0.75 inch). They terminate in a annular ring 107. The spokes are dimensioned circumferentially around the head end so that at the largest opening 109 adjacent the annular ring 107, will be small enough to prevent entry of a finger. It should be appreciated that the nozzle 103 illustrated in FIG. 4 is the same as the nozzle illustrated in FIG. 11 thereby showing a combined system utilizing both the conical depression preventing accidential triggering injection with the extended barrier preventing misdirection injection. Because the spokes are spaced from one another around the circumference, free air flow is provided through the interior of the extended barrier and the spray from the nozzle will not be interfered with by the protective barrier.

Figure 6:
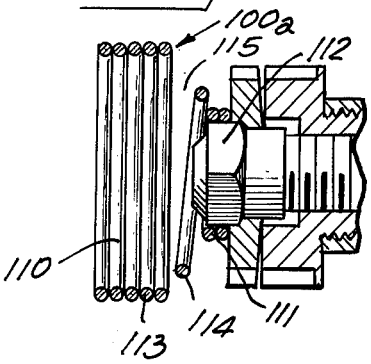
FIG. 6 is a view similar to FIG. 4 illustrating another embodiment of a safety extension.
Figure 7:
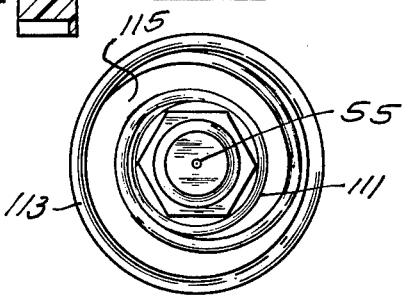
FIG. 7 is a front plan view of the nozzle of FIG. 6.

FIGS. 6 and 7 illustrate a modified form wherein the barrier 100A is constructed of a coiled wire member 110 having small diameter coils 111 adapted to engage the nozzle 112 at the periphery thereof for attachment thereto and larger diameter coils 113 extending outwardly approximately 19.1 mm (0.75 inch) away from the nozzle opening 55. The coils 113 are tightly wound together to prevent accidental entry from the side. An intermediate diameter coil or coils 14 extends from the coils 113 to the coils 111 and is not as tightly wound as the coils 113 thereby providing free air flow through the extended barrier. The openings such as the opening 115 between the connecting coil 114 and the coil 113 and the coils 111 are maintained sufficiently small to prevent entry of the user's fingers. In addition the material of the coils must be chosen with care so that the resulting construction has sufficient rigidity to prevent bending and opening of the coils 113, while at the same time preventing compression of the overall length of the barrier to less than approximately 15.9 mm (0.625 inch).

Figure 12:
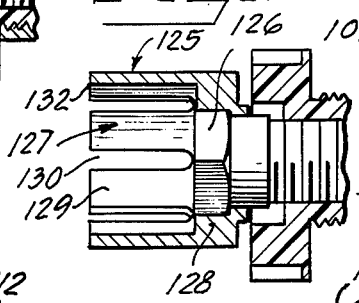
FIG. 12 is a view similar to FIGS. 4 and 6 illustrating another safety extension.

FIG. 12 shows another type of extended barrier 125 attached to a prior art flat face nozzle 126. The extended barrier consists of a tube 127 having a first axial end wall 128 with a first inner diameter surrounding and engaging the periphery of the nozzle 126 together with a tube wall 129 having a second inner diameter larger than said first inner diameter. The tube wall 129 is circumferentially discontinuous and has a plurality of circumferentially spaced axially extending slots 130 extending from the first axial end wall 128 to an opposite outboard open end 132. The slots prevent finger entry and provide a free flow of air through the tube. Again the tube will have a minimum length from the nozzle of 15.9 mm (0.625 inch).

It therefore can be seen from the above that our invention provides a safety assembly for airless paint spray cup guns which includes a projecting barrier extending outwardly from the spray nozzle from a distance of at least 15.9 mm (0.625 inch) preventing accidental skin damage from a continuously operating spray being discharged by the cup gun and also includes a nozzle having a conical depression extending outwardly from the nozzle opening a distance greater than 3.2 mm (0.125 inch) and preferably approximately 8.9 mm (0.350 inch) which functions provide a hydrostatic cushion preventing accidental skin injury upon initial activation of the cup gun with users skin covering a portion at least the open end of the conical depression.

Although the teachings of our invention have herein been discussed with reference to specific theories and embodiments, it is to be understood that these are by way of illustration only and that others may wish to utilize our invention in different designs or applications.

We claim as our invention:

1. A safety nozzle assembly for airless spray cup guns comprising, in combination, a nozzle member having an axial end with a conical depression extending into the axial end and reducing in diameter to a point adjacent a co-axial nozzle orifice open to the depression, the conical depression having a depth between approximately 3 and 9 mm and an included angle of between 30° and 90°, a protective barrier extending outwardly from the nozzle member in the direction of a stream of spray exiting the depression, the barrier including an extended annular member attached to the periphery of the nozzle member, the annular member having a wall portion extending downstream from the nozzle member axial end a distance greater than 15 mm and terminating at an annular open end, the wall portion being circumferentially discontinuous for at least a portion its length providing openings to the interior of the extended barrier radially outwardly and axially adjacent to the nozzle member, the opening providing a free flow of air through the extended barrier, the openings having a dimension preventing accidental entry therethrough to the interior of the barrier of a finger of a user of the cup gun except through the open end, the extended barrier dimensioned to prevent injection of a user's skin by a stream of fluid exiting the nozzle opening when the skin is positioned at the open end, the conical depression preventing injection of the user's skin when the skin substantially covers the depression at the time of activation of the cup gun, the depression providing a hydrostatic cushion by having an internal area between the nozzle opening and the axial face which will be substantially filled by pumped fluid exiting the orifice within a period less than the time period necessary for penetration of the skin of a user by the pumped fluid stream when the skin closes the end face, the conical depression and extended barrier each having a minimum diameter at any point downstream of the nozzle opening greater than the diameter of a cone of spray from the nozzle orifice at that point.

2. A safety barrier for airless cup guns comprising: an extended barrier having first and second axial ends, the first axial end dimensioned to be received around a nozzle member having a circular nozzle orifice therethrough, the second axial end being spaced from the first axial end such that the distance between the second axial end and a nozzle orifice of a nozzle member received within the first axial end will be at least 8.8 mm, the inner diameter of the second axial end being greater than the inner diameter of the first axial end and being dimensioned to provide internal clearance for a cone of spray from the orifice so that the cone is controlled entirely by the orifice, a wall portion extending between the first and second axial ends, the wall portion having openings therethrough providing free flow of air through the extended barrier, the openings being dimensioned to prevent entry of a human finger therethrough.

3. A safety nozzle for airless cup guns comprising: in combination, a nozzle member having an outer periphery, and an axial end, a nozzle orifice open to said axial end, an extended protective barrier having first and second axial ends, the first axial end received around the periphery of the nozzle member in engagement therewith, the second axial end spaced from the nozzle orifice a distance greater than approximately 16 mms., the second axial end including a continuous circumferential annular wall, the second axial end having a diameter greater than the first axial end, a plurality of wall portion spokes connecting the first axial end to the second axial end, the spokes being angled outwardly from the first axial end, the spokes being circumferentially spaced from one another providing openings there between, the openings having a dimension sufficient to prevent entry therethrough of a human finger while providing free flow of air to the interior of the extended barrier.

4. A safety nozzle assembly for airless cup guns comprising in combination a nozzle member having an axial end wall and an outer periphery, a nozzle orifice open to said axial end wall, an extended barrier projecting beyond said axial wall downstream of the nozzle opening, the extended barrier having first and second spaced apart axial end walls, the barrier having a first inner diameter adjacent the first axial end wall engaging the periphery of the nozzle member, the barrier having a second inner diameter greater than the first inner diameter extending from the nozzle member to the second axial wall, the barrier being circumferentially discontinuous throughout the axial length of the second inner diameter providing a plurality of spaced apart wall portions circumferentially around the barrier, the spacing between the wall portions being sufficiently small to prevent entry of a human finger therethrough while allowing a free flow of air to the interior of the barrier, the axial length of the barrier beyond the orifice being sufficiently great to prevent injection of human flesh positioned at the second axial wall by a diverging stream of pumped fluid exiting the orifice.

5. In an airless spray gun having a spray nozzle on a face thereof with a nozzle opening therethrough directing spray away from the gun, said gun having means for forcing fluid to the nozzle at high pressure for ejection through the nozzle opening in a spray pattern controlled downstream from the nozzle by the nozzle, the improvement of a guard preventing penetration of the skin of a user of the gun by the sprayed fluid which comprises an annular barrier surrounding the nozzle and extending downstream therefrom out of the zone of the spray pattern to prevent any change in the spray pattern, said barrier having a free outboard end spaced sufficiently from said nozzle opening so that the spray jet force at said end is insufficient to penetrate the skin of a user of the gun, said barrier having at least one opening upstream from said outboard end thereof to admit air to the interior of the barrier around the spray pattern, and said opening being dimensioned to prevent insertion of a finger of the user of the gun.

6. The added improvement of claim 5 wherein the annular barrier extends downstream from the nozzle opening a distance greater than 15.8 millimeters.

7. The added improvement of claim 5 wherein the nozzle has a circular nozzle opening and the annular barrier is conical diverging from the nozzle to the free outboard end.

8. The added improvement of claim 5 wherein the guard is mounted on the nozzle.

9. In an airless paint spray cup gun having a nozzle on a face thereof with a circular nozzle opening therethrough receiving pumped fluid from the gun at high pressure for ejection through the nozzle opening in a conical spray pattern downstream from the nozzle, an annular barrier extending outwardly from adjacent the nozzle opening dimensioned to encircle a cone of sprayed fluid exiting the nozzle and projecting downstream from the nozzle by a distance sufficiently greater than 3 millimeters effective to prevent injection of sprayed fluid through the skin of a user positioned at an open end of the barrier remote from the nozzle, said barrier having a minimum inner diameter greater than the diameter of the sprayed discharge from the nozzle at any point along the length of the barrier, said barrier comprising a headed nozzle member with axial ends, a bore extending into said headed nozzle member from one axial end terminating in an interior wall, a nozzle opening through said interior wall intermediate the axial ends, a conical depression extending into the nozzle head from the other axial end wall opposite the bore, the conical depression being coaxial with the nozzle opening, the conical depression diverging outwardly to said other axial end wall from adjacent the nozzle opening, the conical depression having an included angle not less than the included angle of the conical spray pattern formed by material exiting the nozzle opening, the conical depression having an axial depth from the nozzle to the end wall in excess of three millimeters and being effective to prevent said injection of sprayed fluid through the skin of the user when said skin is placed over the conical depression prior to activation of said spray gun.

* * * * *